US005359506A

United States Patent [19]

Koleno

[11] Patent Number: 5,359,506

[45] Date of Patent: Oct. 25, 1994

[54] ALL OCCASION LIGHTS

[76] Inventor: Edward J. Koleno, Box 226, Clarence, Pa. 16829

[21] Appl. No.: 202,598

[22] Filed: Feb. 28, 1994

[51] Int. Cl.[5] ..... F21V 17/06

[52] U.S. Cl. ..... 362/248; 362/806; 362/457; 362/353; 362/252; 362/255; 362/256; 362/237

[58] Field of Search ..... 362/252, 237, 806, 807, 362/808, 457, 443, 360, 352, 353, 121, 235, 236, 242, 351, 354, 255, 256, 248

[56] References Cited

U.S. PATENT DOCUMENTS

| | | | |
|---|---|---|---|
| 452,701 | 5/1871 | Gastner et al. | 362/283 |
| 1,086,787 | 2/1914 | Rithner | 362/255 |
| 1,349,374 | 8/1920 | Gruenfeld | 362/808 X |
| 2,465,700 | 3/1949 | Tuttle | 362/808 X |
| 2,500,899 | 8/1950 | Leahan | 46/57 |
| 2,794,116 | 5/1957 | Morin, nee Faust | 362/353 X |
| 2,815,439 | 12/1957 | Plubell | 362/806 X |
| 3,619,599 | 11/1971 | Hermanson | 240/10 B |
| 3,689,762 | 9/1972 | Shatan | 362/360 |
| 4,234,915 | 11/1980 | Malinowski et al. | 362/252 |
| 4,601,924 | 7/1986 | Birker et al. | 428/7 |
| 4,682,079 | 7/1987 | Sanders et al. | 315/186 |
| 4,698,735 | 10/1987 | Hirono | 362/806 X |
| 4,833,580 | 5/1989 | Allen | 362/451 |
| 5,012,397 | 4/1991 | Tseng | 362/806 X |
| 5,091,833 | 2/1992 | Paniaguas et al. | 362/252 X |
| 5,184,890 | 2/1993 | Chen et al. . | |
| 5,274,537 | 12/1993 | Altman | 362/353 |

*Primary Examiner*—Ira S. Lazarus
*Assistant Examiner*—Thomas M. Sember
*Attorney, Agent, or Firm*—Rhodes & Ascolillo

[57] ABSTRACT

In a preferred embodiment, an all occasion light system providing for a permanent installation at a preferred location, the system including: a plurality of spaced apart, electrically connected base members, having structure to insert therein a plurality of light bulbs; structure to removably attach ornaments over the light bulbs with the ornaments to be illuminated thereby; and structure to individually conceal each of the light bulbs when the ornaments are removed.

3 Claims, 4 Drawing Sheets

ALL OCCASION LIGHTS

BACKGROUND OF THE INVENTION

1. Field of the Invention

The present invention relates to ornamental lights generally and, more particularly, but not by way of limitation, to a novel string of lights having ornaments disposed over the lights, the ornaments being changeable permitting the string of lights to be permanently installed and thereby utilized for different events.

2. Description of the Related Art

U.S. Pat. No. 2,500,899, issued Mar. 14, 1950, to Leahan, describes an animated display device comprising an ornamental device having an electric lamp bulb and having various means to simulate animation.

U.S. Pat. No. 3,619,599, issued Nov. 9, 1971, to Hermanson, describes a decorative light set comprising a hinged extensible multilight fixture providing for different light string formations.

U.S. Pat. No. 4,601,924, issued Jul. 22, 1986, to Birkes et al. describes a tree ornament in which a plurality of images are produced by two-dimensional objects.

U.S. Pat. No. 4,682,079, issued Jul. 21, 1987, to Sanders et al., describes a decorative device which includes a motor, music module, or other electrical loads and electrical circuitry and a connector for connection to a selected socket of a string of conventional sockets for connection to an AC line.

U.S. Pat. No. 4,833,580, issued May 23, 1989, to Allen, describes an illuminated hollow decorative ornament having support means independent of the associated light source or the support structure of the associated light source.

SUMMARY OF THE INVENTION

Many people enjoy displaying an array of lights at certain times of the year. The lights are set up at the appropriate time and then taken down again when the season or event has passed. This requires the storage and retrieval of a variety of light strings containing the appropriate ornaments and the installation and removal of strings of lights including connection to a power source. For a person or family that enjoys taking part in many of the special days and seasonal events during a year, a considerable amount of time is required for storage, retrieval, installation, and removal of these materials in addition to the extra storage space required. These are all problems that to some extent may be exacerbated by inclement weather or lack of adequate time. None of the above devices provides a solution for the problems set forth above.

Accordingly, it is a principal object of the present invention to provide all occasion lights which may be permanently installed in a preferred location.

It is another object of the present invention to provide all occasion lights which permit interchanging ornaments for different special days or seasonal events such as Memorial Day, Fourth of July, Halloween, Thanksgiving, Christmas, Easter, Chanukah, etc.

It is a further object of the present invention to provide means to conceal each light bulb when the ornaments have been removed and the all occasion lights are not in use.

Another object of the present invention is to minimize installation and removal time by simply having to work with the installation and removal of ornaments, not the handling of one or more string of lights with associated wiring which often needs untangling.

A further object of the present invention is to minimize storage by simply having to store ornaments, not one or more strings of lights with associated wiring.

The present invention achieves the above objects, among others, in a preferred embodiment that provides an all occasion light system providing for a permanent installation at a preferred location, the system comprising: a plurality of spaced apart, electrically connected base members, having means to insert therein a plurality of light bulbs; means to removably attach ornaments over the light bulbs with the ornaments to be illuminated thereby; and means to individually conceal each of the light bulbs when the ornaments are removed.

The means to removably attach ornaments over the light bulbs comprises: a plurality of sockets, each one of the sockets attached to one of the base members and having an outer circumference provided with a first screw thread; and a plurality of mounting stems, each one of the mounting stems disposed on a bottom of one of the ornaments and having an inside circumference containing a second screw thread matable with the first screw thread to removably attach the one of the ornaments to the one of the sockets.

The means to conceal the light bulbs comprises: a plurality of opaque covers; and means to removably attach each of the opaque covers to each of the base members when the ornaments are removed from the base members.

The means to removably attach the opaque covers comprises: two, parallel, spaced apart, U-shaped channels which are formed as extensions of bottom edges of side surfaces of the opaque cover, the extensions being bent inwardly and upwardly to form the U-shaped channels; and two, parallel flanges depending from outer edges of an upper portion of the base member and spaced apart from a lower portion of the base member, the side flanges and the U-shaped channels forming complementary mating structures.

The all occasion light system also has side flanges and U-shaped channels that are sufficiently different in dimensional relationship so as to provide slight frictional engagement therebetween when the side flanges are mated to the U-shaped channels.

Other objects of the present invention, as well as particular features, elements, and advantages thereof, will be elucidated in, or be apparent from, the following description and the accompanying drawing figures.

BRIEF DESCRIPTION OF THE DRAWINGS

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENT

Figure 1:
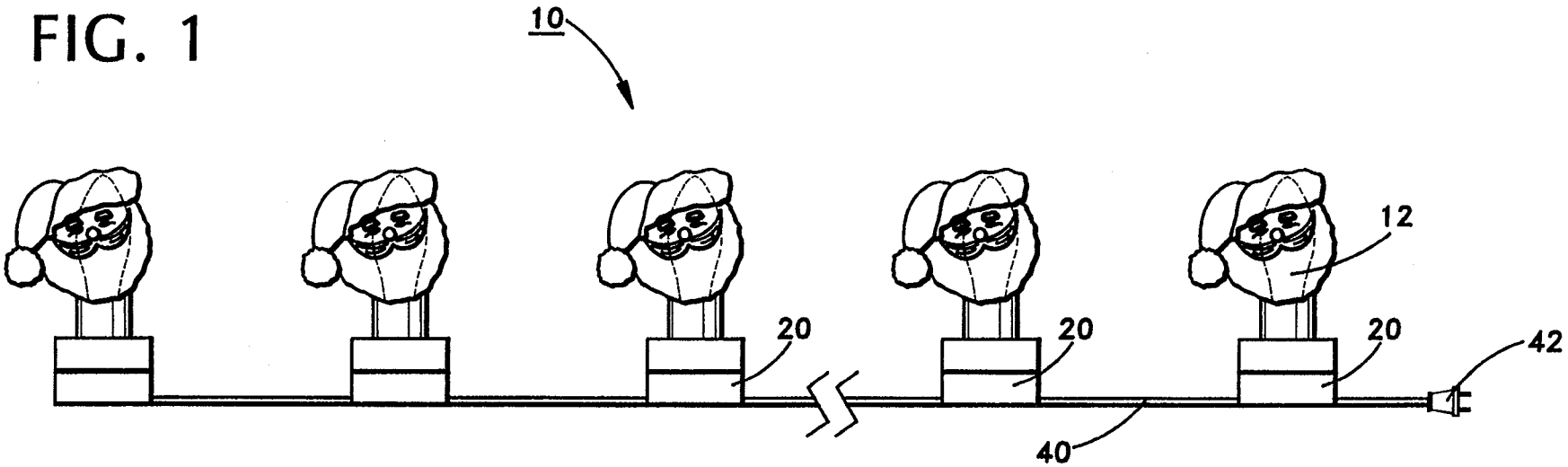
FIG. 1 is a fragmentary side elevational view of an all occasion light string with ornaments installed over light bulbs, according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Figure 2:
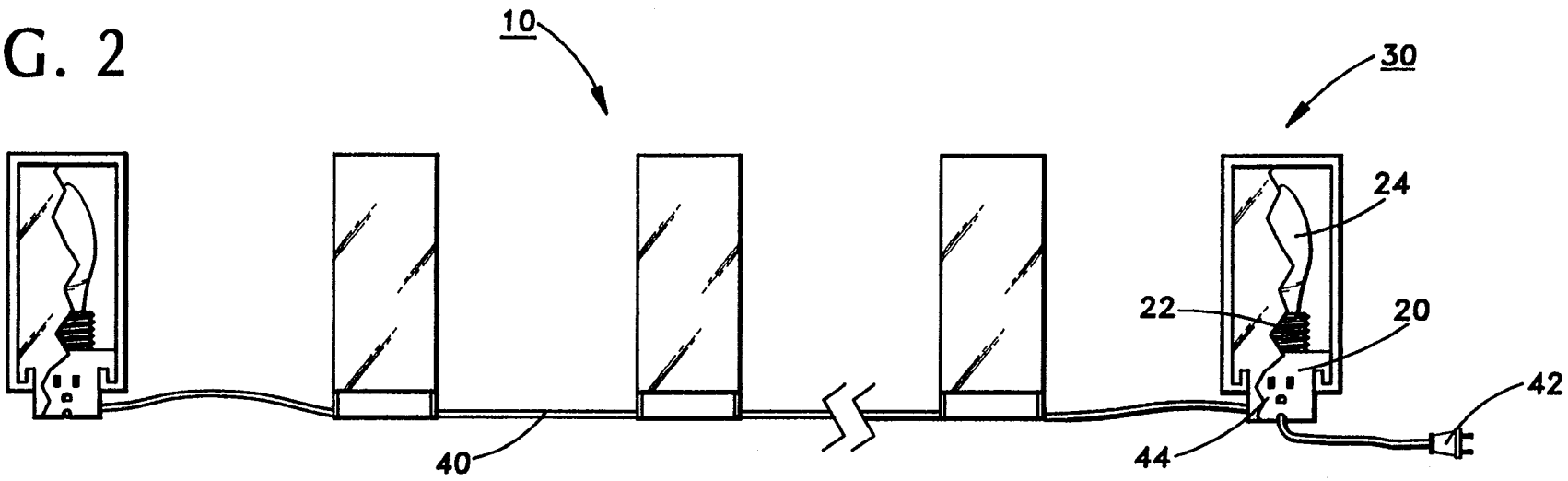
FIG. 2 is a fragmentary side elevational view of the all occasion light string with opaque covers installed over the light bulbs with a partial cutaway view to show the light bulbs inside the opaque covers.

Reference should now be made to FIGS. 1 and 2 which show an all occasion light system of the present invention, generally indicated by reference numeral 10, in the preferred embodiment.

All occasion light system 10 includes interchangeable ornaments, as at 12 (FIG. 1), each of which is installed on a base member 20 and envelops a light bulb 24 (FIG. 2), whereby ornament 12 can be illuminated from its interior. Ornament 12 is a Santa Claus figure, but the ornament could be any other desired ornament, as will be described later. All occasion light system 10 further includes opaque covers, such as generally indicated by reference numeral 30 (FIG. 2), to be installed on each base member 20 whenever ornament 12 has been removed, such that light bulb 24 and a metallic socket 22 (FIGS. 2 and 3) to which light bulb 24 is attached are not visible. Light system 10 also includes wiring 40 which interconnects a plurality of metallic sockets 22 by a method well-known in the art (not shown) and which also provides connection to a voltage source (not shown) via power connector 42. An electrical socket 44 may be provided on base member 20 for the connection thereto of other light systems or other electrical devices (not shown), if desired. It will be understood that any number of base members 20 can be provided in system 10.

Figure 3:
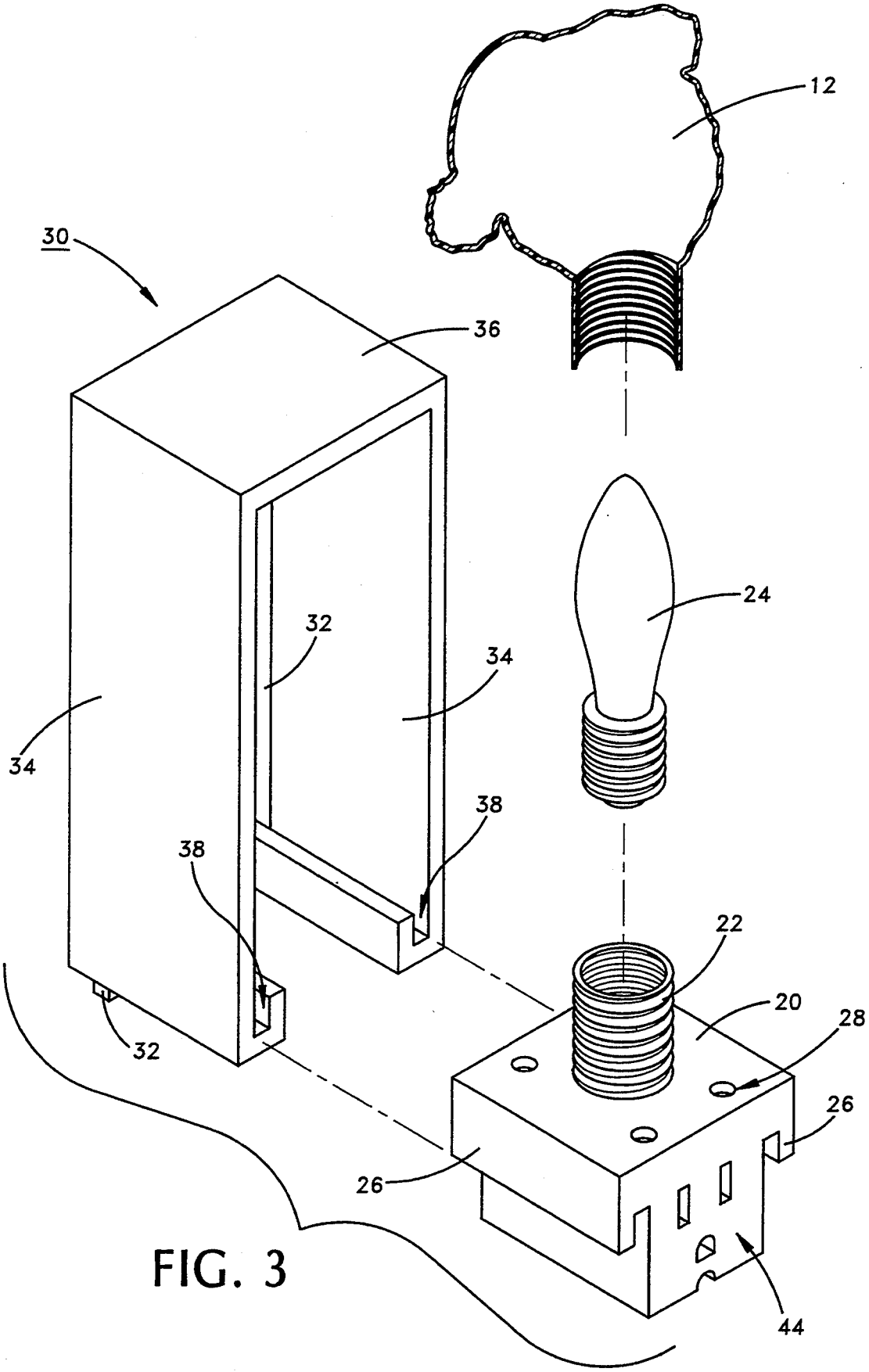
FIG. 3 is an exploded isometric view, partially cutaway, of one light bulb section of the all occasion light string.

Reference should now be made to FIG. 3 which shows base member 20 having metallic socket 22 which is both threaded on its inner circumference, so as to receive light bulb 24 which is matingly threaded to screw into socket 22, and threaded on its outer circumference in order to receive ornament 12 which is matingly threaded to screw onto the outside of metallic socket 22. Base member 20 also includes two, parallel, vertical side flanges 26 depending from the outer edges of an upper portion of base member 20. The two parallel vertical side flanges 26 and which are parallel to and spaced apart from a lower portion of the base member. Base member 20 also includes a plurality of mounting openings 28 defined therethrough, to permit a variety of convenient mounting arrangements using nails, screws, or flexible tying materials (none shown) to attach each base to some structure or surface.

FIG. 3 also shows opaque cover 30 which forms a rectilinear partial enclosure having cojoined two side walls 34, and a top wall 36. Opaque cover 30 includes two, parallel, spaced apart, U-shaped channels 38 which are formed as extensions of the bottoms of side surfaces 34, the extensions being bent inwardly and upwardly to form U-shapes. Flanges 26 and U-shaped channels 38 are configured to form complementary mating structures and the dimensions thereof are sufficiently different so as to provide slight frictional engagement when the flanges are mated with the U-shaped channels.

Figure 4:
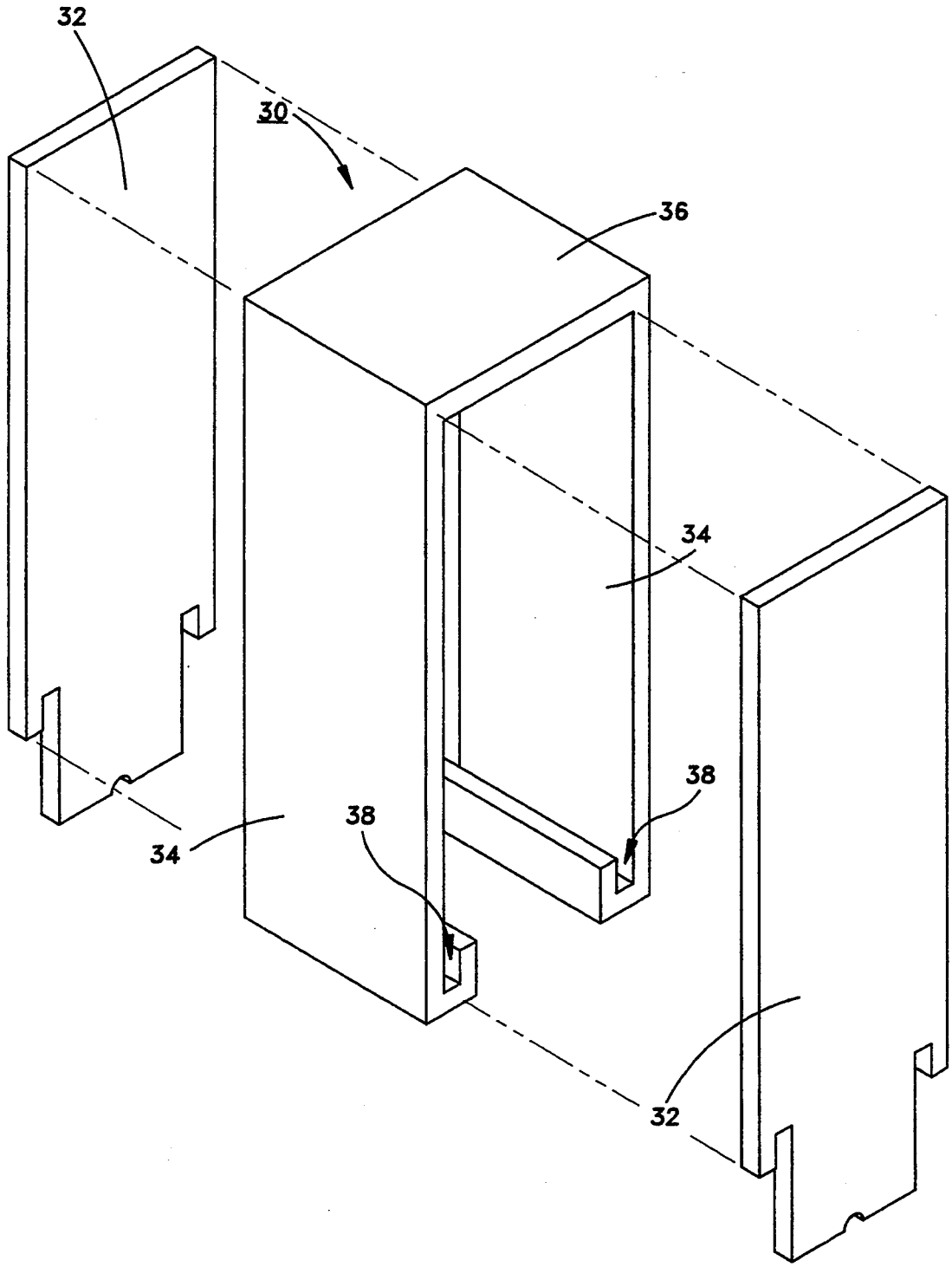
FIG. 4 is an exploded view of a light bulb cover.

As best seen in FIG. 4, opaque cover 30 also includes two end plates 32, each end plate having two parallel vertical side flanges 39 depending from the outer edges of a lower portion of the end plate, and having a wire clearance groove disposed at the bottom center of the plate. Each end plate 32 is configured to snugly fit within the inner perimeter formed by walls 34 and 36 and channels 38 such that each end plate 32 is frictionally held in place. The end plates 32 can then be easily removed or attached.

Figure 5:
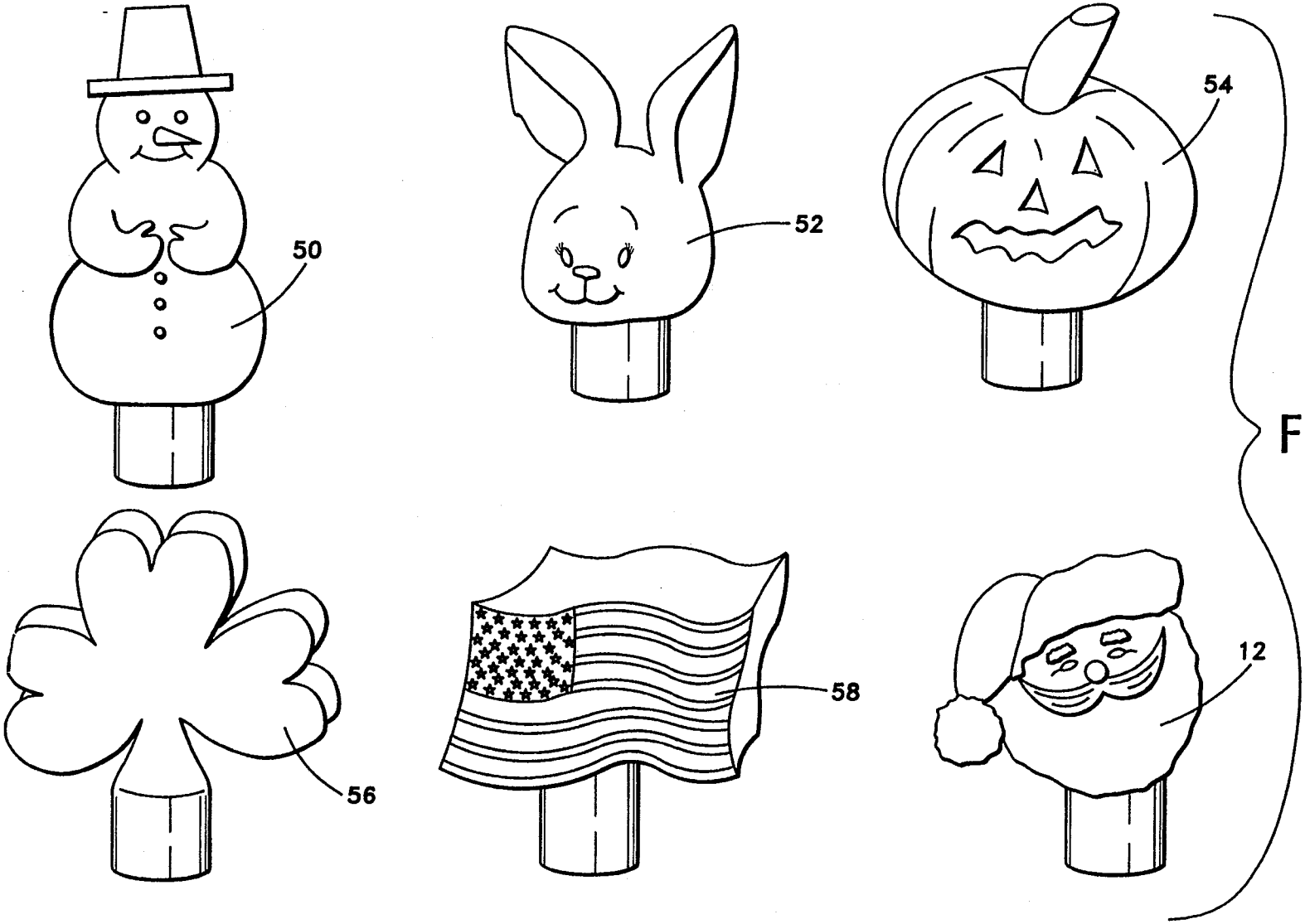
FIG. 5 is an isometric view showing a variety of interchangeable ornaments which may be used with the all occasion light string.

FIG. 5 shows a variety of interchangeable ornaments, in addition to ornament 12, which could be used with all occasion light system 10, including a Winter Snowman 50, an Easter Rabbit 52, a Halloween Jack-0-Lantern 54, a St. Patrick's Day Shamrock 56, and an American Flag 58.

In use, all occasion light system 10 may be permanently installed to host structures in preferred outdoor location such as under roof eaves, around window frames, doorway frames, and in bushes and shrubbery, or in preferred indoor locations such as around window frames, doorway frames, and on walls (none shown). Mounting openings 28 (FIG. 3), permit convenient means to permanently attach all occasion light system 10 to the host structures. Once installed, the user may select one or even two or more types of ornaments (Fig. 4) to insert on base members 20, depending on the season or occasion being celebrated, to provide the display similar to that shown on FIG. 1. When the season or occasion passes, the ornaments may be replaced with other ornaments, or, if not so replaced, opaque covers 30 may be installed on base members 20 to provide a clean appearance and to provide some protection for sockets 22. Opaque covers 30 may be colored or decorated to blend with the surroundings to make the covers less noticeable.

Ornaments 30 could be clear or opaque, and could be used for, without being limited to, night lighting, advertising, or decoration.

Base member 20 could be made of an elastomeric material which also serves as an electrical insulator.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. An all occasion light system providing for a permanent installation at a preferred location, said system comprising:

(a) a plurality of spaced apart, electrically connected base members, having means to insert therein a plurality of light bulbs;

(b) means to removably attach ornaments over said light bulbs, with said ornaments to be illuminated thereby, comprising:

a plurality of sockets, each one of said sockets attached to one of said base members and having an outer circumference provided with a first screw thread; and a plurality of mounting stems, each one of said mounting stems disposed on a bottom of one of said ornaments and having an inside circumference containing a second screw thread matable with said first screw thread to removably attach said one of said ornaments to said one of said sockets; and (c) means to individually conceal each of said light bulbs, when said ornaments are removed, comprising:

a plurality of opaque covers; and means to removably attach each of said opaque covers, to each of said base members when said ornaments are removed from said base members, comprising two, parallel, space apart, U-shaped channels which are formed as extensions of bottom edges of side surfaces of said opaque cover, said extensions being bent inwardly and upwardly to form said U-shaped channels; and two, parallel flanges depending from outer edges of an upper portion of said base member and spaced apart from a lower portion of said base member, said side flanges and said U-shaped channels forming complementary mating structures.

2. An all occasion light system, as defined in claim 1, whereby said side flanges and said U-shaped channels are sufficiently different in dimensional relationship so as to provide slight frictional engagement therebetween when said side flanges are mated to said U-shaped channels.

3. An all occasion light system providing for a permanent installation at a preferred location, said system comprising:

(a) a plurality of spaced apart, electrically connected base members, having means to insert therein a plurality of light bulbs;

(b) means to removably attach ornaments over said light bulbs, with said ornaments to be illuminated thereby, comprising:

a plurality of sockets, each one of said sockets attached to one of said base members and having an outer circumference provided with a first screw thread; and a plurality of mounting stems, each one of said mounting stems disposed on a bottom of one of said ornaments and having an inside circumference containing a second screw thread matable with said first screw thread to removably attach said one of said ornaments to said one of said sockets; and (c) means to individually conceal each of said light bulbs, when said ornaments are removed, comprising:

a plurality of opaque covers; and means to removably attach each of said opaque covers, to each of said base members when said ornaments are removed from said base members, comprising two, parallel, spaced apart, U-shaped channels which are formed as extensions of bottom edges of side surfaces of said opaque cover, said extensions being bent inwardly and upwardly to form said U-shaped channels;

two, parallel flanges depending from outer edges of an upper portion of said base member and spaced apart from a lower portion of said base member;

said side flanges and said U-shaped channels forming complementary mating structures; and said side flanges and said U-shaped channels are sufficiently different in dimensional relationship so as to provide slight frictional engagement therebetween when said side flanges are mated to said U-shaped channels.

* * * * *